US005972877A

United States Patent [19]

Tsuda et al.

[11] Patent Number: 5,972,877

[45] Date of Patent: Oct. 26, 1999

[54] DETERGENT COMPOSITION COMPRISING CRYSTALS OF A NEUTRAL SALT OF AN ANIONIC SURFACTANT

[75] Inventors: Hiroko Tsuda; Takashi Komori, both of Tokyo, Japan

[73] Assignee: Kao Corporation, Tokyo, Japan

[21] Appl. No.: 09/048,161

[22] Filed: Mar. 26, 1998

[30] Foreign Application Priority Data

Apr. 10, 1997 [JP] Japan ..... 9-092341

[51] Int. Cl.[6] ..... C11D 17/00

[52] U.S. Cl. ..... 510/426; 510/159; 510/137; 510/432; 510/471; 510/506

[58] Field of Search ..... 510/137, 147, 510/151, 152, 155, 159, 426, 432, 471, 506

[56] References Cited

U.S. PATENT DOCUMENTS 4,165,293 8/1979 Gordon ..... 252/118
4,980,078 12/1990 Verite et al. ..... 252/118
5,002,685 3/1991 Chambers et al. ..... 252/134
5,496,489 3/1996 Dussault et al. ..... 252/134

*Primary Examiner*—Necholus Ogden
*Attorney, Agent, or Firm*—Oblon, Spivak, McClelland, Maier & Neustadt, P.C.

[57] ABSTRACT

Provided is a detergent composition, which comprises the following components (A), (B) and (C):

(A) 50 to 95 wt. % of a polyol or polyol ether which can dissolve at least 1 wt. % of palmitic acid at 35° C., (B) 1 to 30 wt. % of crystals of a neutral salt of an anionic surfactant, and (C) 0.1 to 20 wt. % of a thickener; and has a water content of 10 wt. % or less. It can simultaneously wash off sebum in the paste or solid form and sebum in the liquid form and does not impart dry, flaky and stretched feelings to the skin.

7 Claims, No Drawings

DETERGENT COMPOSITION COMPRISING CRYSTALS OF A NEUTRAL SALT OF AN ANIONIC SURFACTANT

BACKGROUND OF THE INVENTION

1. Field of the Invention

The present invention relates to a detergent composition which can simultaneously wash off degenerated sebum in the paste or solid form which otherwise causes blocking or darkening of the pores of the skin and sebum in the liquid form.

2. Description of the Related Art

The conventional detergent for those having a greasy skin is mainly a soap which contains an anionic surfactant having a high degreasing power (detergency). Owing to high pH and high concentration of the surfactant, such a detergent causes high skin irritation. It also cleanses the whole object including non-greasy parts so that strong washing causes problems such as dry flaky skin or a stretched feeling after cleansing.

Conventional aqueous detergents can wash off liquid sebum on the skin but cannot wash off the degenerated sebum which contains much fatty acid and has a high melting point. Such sebum is in the paste or solid form and causes blocking or darkening of the pores of the skin.

A non-aqueous detergent composition which can wash off pore sebum in the paste or solid form has been proposed. It is composed of a comedolytic alcohol, an activated zeolite and a nonionic surfactant (Japanese Patent Laid-Open No. HEI 8-59455). This non-aqueous detergent cannot be used as a complete substitute for conventional detergents, because it can only be applied to parts where the pores seem to be blocked. In addition, this detergent has the touch feeling different from that of the conventional detergents upon rinsing and cleansing with it is not satisfactory.

An object of the present invention is therefore to provide a detergent composition which can simultaneously wash off sebum in the paste or solid form and sebum in the liquid form, does not cause dry, flaky or stretched skin and is excellent in feeling upon use.

SUMMARY OF THE INVENTION

In view of the foregoing circumstances, the present inventors have carried out an extensive investigation. As a result, it has been found that when a non-aqueous detergent composition comprising a comedolytic polyol and a crystalline anionic surfactant is used in a non-aqueous form, plugs in the pores can be dissolved and washed off by the polyol and no dry or stretched feeling is imparted to the skin after cleansing; and when water is employed upon rinsing and washing, the anionic surfactant dissolves therein and exhibits its essential function, whereby the sebum in the liquid form can be washed off similar to the conventional aqueous detergents, leading to the completion of the present invention.

In the present invention, there is thus provided a detergent composition, which comprises the following components (A), (B) and (C):

(A) 50 to 95 wt. % of a polyol or polyol ether which can dissolve therein at least 1 wt. % of palmitic acid at 35° C., (B) 1 to 30 wt. % of crystals of a neutral salt type anionic surfactant, and (C) 0.1 to 20 wt. % of a thickener; and has a water content of 10 wt. % or less.

The detergent composition according to the present invention can simultaneously wash off sebum in the paste or solid form or sebum in the liquid form, does not impart a stretched or dry, flaky feeling to the skin after cleansing and is excellent in feeling upon use.

DETAILED DESCRIPTION OF THE PREFERRED EMBODIMENTS

As component (A), no particular limitation is imposed on the polyol or polyol ether insofar as it can dissolve therein at least 1 wt. % of palmitic acid at 35° C. That in the liquid form at normal temperature and pressure is however preferred. Examples include diethylene glycol monoethyl ether (ethyl carbitol), isoprene glycol, hexylene glycol, 1,2-pentane diol, polyethylene glycol (average molecular weight is about 400), dipropylene glycol, ethylene glycol monobutyl ether, ethylene glycol monoethyl ether, 1,3-butylene glycol, 2-ethyl-1,3-hexanediol, diethylene glycol, propylene glycol and tris(ethoxyethoxyethyl)phosphate. Among them, diethylene glycol monoethyl ether, isoprene glycol, hexylene glycol, dipropylene glycol, 1,3-butylene glycol and tris(ethoxyethoxyethyl)phosphate are particularly preferred. Such polyols can dissolve the degenerated sebum in the paste or solid form and have excellent penetration into the pores of the skin.

The above-exemplified polyol or polyolether (hereinafter referred to as polyols) as component (A) can be used either singly or in combination and incorporated in the detergent composition of the present invention in an amount of 50 to 95 wt. %, preferably 60 to 90 wt. %. When the amount of component (A) is less than 50 wt. %, the resulting composition has decreased detergency of the degenerated sebum in the paste or solid form. When the amount exceeds 95 wt. %), on the other hand, the relative amount of the anionic surfactant decreases, resulting in the decreased foamability during rinsing and washing.

It is important that the neutral-salt type anionic surfactant as component (B) is crystalline in the composition; in other words, it should not dissolve in the polyol which is component (A). Accordingly, an acid-type anionic surfactant having a high solubility in polyols cannot be used. Incidentally, the term "crystalline" of component (B) as used herein means that the phase is required to be clearly different from the liquid phase in the composition and embraces both the crystalline or liquid crystalline phase. Moreover, the existence of crystals of the neutral salt can be confirmed by recognizing one or more peaks in an X-ray wide-angle region or by recognizing anisotropy through a polarizing microscope. Furthermore, it is necessary that component (B) has a particle size such that it permits easy dissolution by water at the time of rinsing. The maximum particle size (defined as the largest dimension when viewed from three optional angles) is 2 mm. Preferable particle size of component (B) is 500 $\mu$m or less in view that it does not impart a feeling of foreign substance and physical irritation upon use in a non-aqueous form. Examples of component (B) include alkyl phosphates such as lauryl phosphate, myristyl phosphate, 2-hexyldecyl phosphate; alkyl sulfonates such as lauryl glyceryl ether sulfonate and myristyl glyceryl ether sulfonate; fatty acid salts such as laurate, myristate, palmitate and stearate; N-acyl methyl taurine salts such as N-lauroyl methyl taurine salt, N-myristoyl methyl taurine salt and N-cocoyl methyl taurine salt; and N-acyl amino acid salts such as N-lauroyl glutamate, N-lauroyl glycinate, N-lauroyl-β-alanine salt and salt of acylimino dibasic acid (N-acylcarboxyethyl glycinate, etc.). The alkyl or acyl group of the above-described neutral salt type anionic surfactants is preferred to have 10 to 20 carbon atoms, with 12 to 18 carbon atoms being particularly preferred. Examples of a counter ion of the neutral salt include alkaline metals such as sodium, potassium and lithium; amino acids such as arginine and lysine; and tertiary amines such as triethylamine. Among them, alkaline metals are preferred, with potassium and sodium being particularly preferred.

The above-described neutral salt type anionic surfactants can be used either singly or in combination and may be incorporated in the detergent composition of the present invention in an amount of 1 to 30 wt. %, preferably 5 to 20 wt. %. When the amount of component (B) is less than 1 wt. %, the resulting composition has decreased foamability. When the amount exceeds 30 wt. %, on the other hand, the concentration of component (B) becomes too high at the foaming and washing time, which gives the cleansed skin with a flaky or stretching feeling.

Component (C) is added as a thickener in order to ease the handling, improve the dispersibility of the neutral salt type anionic surfactant which is component (B), and improve the massaging property upon use in the non-aqueous form. As component (C), those having a high affinity for polyols, that is, component (A) are suited. Preferred examples include hydroxypropyl cellulose and polyvinyl pyrrolidone.

The above-described thickeners as component (C) can be used either singly or in combination and may be incorporated in the detergent composition of the present invention in an amount of 0.1 to 20 wt. %, preferably 0.5 to 10 wt. %, particularly preferably 1 to 5 wt. %). It is desired to adjust the viscosity at 25° C. of the detergent composition at 5,000 to 70,000 cp, particularly 10,000 to 50,000 cp.

The detergent composition of the present invention is required to be substantially non-aqueous type, in other words, to be almost water-free. When water is contained in the raw materials employed, the resulting composition inevitably contains water to some extent. The term "substantially non-aqueous type" as used herein means that the water content in the composition is not greater than 10 wt. %, with not greater than 7 wt. %, being particularly preferred. When the water content in the detergent composition exceeds 10 wt. %, the solubility of pore sebum in the paste or solid form decreases.

In addition to the above-described essential components, it is possible to incorporate other components ordinarily used in detergents in a range that does not impair the advantage of the present invention. Examples of such components include humectants such as sorbitol or glycerin, foam increasing agents such as betaine surfactant, detergent assistants such as nonionic surfactant, viscosity regulators other than component (C); and other additives such as perfumes, colorants, ultraviolet absorbers, antioxidants, bactericides, anti-inflammatory agents, antiseptics, oily agents, medicaments, foaming agents and cooling agents. In particular, humectants and nonionic surfactants can be added within an extent not disturbing the solubility of comedo.

The detergent composition of the present invention can be prepared by mixing components (A), (B) and (C) and other components in a manner known per se in the art. Alternatively, it can be prepared by mixing these components except component (B) and any not-neutral acid type anionic surfactants corresponding to component (B), adding a neutralizing agent such as alkali hydride to the resulting mixture to react them, and precipitating the neutral salt of the anionic surfactant as a disperse phase.

It is desirable to use the detergent composition of the present invention for the purpose of cleansing the skin, particularly, facial skin. When used for this purpose, an adequate amount of the detergent is taken in hands and the parts which seem to have blocked pores are massaged without water. The polyol, that is, component (A), in the detergent dissolves sebum in the paste or solid form which will otherwise cause darkening of the pores or rough skin. The neutral salt type anionic surfactant (component (B)) is, on the other hand, exists in an insoluble state so that it does not act on the skin, thereby not imparting the skin with excessive irritation. Then, water is added and the whole surface is rinsed in a similar manner employed with conventional cleansing compositions. This makes it possible to dissolve component (B) in water, allow it to act as a surfactant, cause foaming and wash off sebum in the liquid form.

EXAMPLES

The present invention will hereinafter be described more specifically by the following examples, but it should however be borne in mind that the present invention is not limited to or by the following examples.

Example 1

Detergents were prepared in a manner known per se in the art by using the components shown in Table 1 and the state of the anionic surfactant in the system, cleansing effects, and any stretched or flaky feelings after the cleansing were compared. The results are shown in Table 1.

(Testing method)

State of the neutral salt type anionic surfactant

By microscopic observation under polarization, the state of the neutral salt type anionic surfactant in each detergent was investigated.

Evaluation standards:

A: Crystal to liquid crystal (existence of anisotropy under microscopic observation; maximum particle size not greater than 2 mm)

B: Dissolved (absence of anisotropy under microscopic observation)

Change in the darkening degree of the pores

The surface of the nose of a panel of experts was massaged with each detergent, followed by the addition of water, foaming and cleansing. Cleansing was carried out once a day for two weeks and the change in the darkening degree of the pores of the nose was investigated.

Stretch and dry, flaky feeling

After cleansing, the panel of experts was allowed to enter a room air-conditioned at 20° C. and 40% RH. An organoleptic evaluation of the stretched feeling of the face was conducted five minutes after cleansing according to the following standards:

A: no stretched feeling

B: slightly stretched feeling but negligible

C: not negligible degree of stretched feeling

D: stretched feeling and uncomfortable

The presence or absence of desquamation at that time was also observed. Any dry, flaky feeling after the cleansing was evaluated according to the following standards:

Evaluation standards (dry flaky feeling):

+: desquamation was observed.

±: slight desquamation was observed.

−: no desquamation was observed.

TABLE 1

(wt. %)

| | Invention product | | | | | | Comparative product | | | |
|---|---|---|---|---|---|---|---|---|---|---|
| | 1 | 2 | 3 | 4 | 5 | 6 | 1 | 2 | 3 | 4 |
| Ethyl carbitol | — | 10 | 10 | 20 | 15 | 10 | — | — | — | — |
| Isoprene glycol | — | 40 | 40 | 30 | 30 | 40 | 10 | — | — | — |
| Hexylene glycol | 20 | — | — | — | — | — | — | — | — | — |
| 1,3-Butylene glycol | 63 | 33 | 36 | 20 | 20 | 33 | 10 | — | — | — |
| Glycerin | — | — | — | 10 | — | — | 33 | — | — | 20 |
| Polyethylene glycol 400 | — | — | — | — | — | — | — | — | 10 | — |
| Water | 2* | 2* | — | 2* | 6* | 2* | 32* | 85* | 72* | 51* |
| Potassium laurylphosphate (crystalline powder) | 4 | 4 | 4 | 4 | 8 | 4 | 4 | 4 | 4 | 8 |
| Potassium laurate (crystalline powder) | 8 | 8 | 8 | 8 | 16 | — | 8 | 8 | 8 | 16 |
| Arginine 2-hexyldecylphosphate (liquid crystal) | — | — | | — | — | 8 | — | — | — | — |
| Lauryl dimethylamine oxide | 1* | 1* | — | 1* | 3* | 1* | 1* | 1* | 1* | 3* |
| Polyoxyethylene (20) sorbitan laurate | — | — | — | 3 | — | — | — | — | 3 | — |
| Hydroxypropyl cellulose | 2 | 2 | 2 | 2 | 2 | 2 | 2 | 2 | 2 | 2 |
| Viscosity (cp) at 25° C. | 18000 | 24000 | 22000 | 18000 | 36000 | 16000 | 16000 | 9000 | 11000 | 29000 |
| State of neutral salt type anionic surfactant | A | A | A | A | A | A | B | B | B | B |
| Evaluation | | | | | | | | | | |
| change in blackening degree of pores of the skin (after 2 weeks) | decrease | decrease | decrease | decrease | decrease | decrease | No change | No change | No change | No change |
| Stretched feeling | B | A | B | B | A | A | C | C | C | C |
| dry, flaking feeling (desquamation) | — | — | — | — | — | — | ± | ± | ± | ± |

*"Water" contains that attributable to the use ot a 33 wt. % aqueous solution of lauryl dimethylamine oxide. The amount of lauryl dimethylamine oxide is the net amount.

Example 2

By using the following components, a detergent (invention product 7, viscosity: 20,000 cp) was prepared in a manner known per se in the art. The cleansing effect of that product was compared with that of comparative product 3. The results are shown in Table 2. Incidentally, the detergent of invention product 7 was found to exhibit anisotropy by microscopic observation under polarization and it was confirmed that the neutral salt anionic surfactant existed as crystals without being dissolved.

| | (wt. %) |
|---|---|
| Ethyl carbitol | 20 |
| Isoprene glycol | 50 |
| Glycerin | 11 |
| Potassium myristate (crystalline powder) | 7 |
| Potassium lauryl phosphate (crystalline powder) | 7 |
| Lauroylhydroxysulfobetaine | 1* |
| Water | 2* |
| Hydroxypropyl cellulose | 2 |
| | 100 |

*: water content is attributable to the use of a 33 wt. % aqueous solution of lauroylhydroxysulfobetain. The amount of lauroylhydroxysulfobetaine is the net amount.

(Testing method)

A model having a greasy skin was asked to cleanse one half of her face with invention product 7 and the other half with comparative product 3. Then, a make-up foundation was applied and the glitterings of the skin after two, three and four hours were compared and evaluated by a panel consisting of 5 experts. In addition, changes in the darkening degree of the pores were evaluated after the cleansing was conducted once a day for one week.

TABLE 2

| | 2 hours | 3 hours | 4 hours |
|---|---|---|---|
| Invention product 7 prevents glittering | 2 | 4 | 4 |
| Comparative Product 3 prevents glittering | 0 | 1 | 0 |
| No definite difference | 3 | 0 | 1 |

| | Invention Product 7 | Comparative Product 3 |
|---|---|---|
| Change in the darkening degree of pores of the nose | Decrease | No change |

Example 3

A detergent was prepared in a manner known per se in the art from the components shown in Table 3. The state of the anionic surfactant in the system, the feeling of refreshment after cleansing and its duration, and the stretched and dry, flaking feelings after cleansing were evaluated. The results are shown in Table 3.

(Testing method)

The state of neutral salt type anionic surfactant

The state was confirmed in a similar manner as in Example 1.

Feeling of refreshment and its duration

Experts forming a panel cleansed their faces with each detergent and an organoleptic evaluations of the feeling of refreshment just after cleansing and three hours after cleansing were conducted in accordance with the following standards:

Evaluation standards (feeling of refreshment):

A: Good

B: Slightly good

C: Not so good

Stretched and dry, flaky feeling

Evaluation was conducted in a similar manner and according to similar standards as in Example 1.

TABLE 3

(wt. %)

| | Invention products | | | | Comparative product |
|---|---|---|---|---|---|
| | 8 | 9 | 10 | 11 | 5 |
| Ethyl carbitol | 10 | — | 20 | — | — |
| Dipropylene glycol | 30 | 30 | 55 | 30 | — |
| 1,3-butylene glycol | 40 | 35 | — | 30 | — |
| Glycerin | — | — | 10 | — | 20 |
| Ethanol | — | 15 | — | — | — |
| Sodium laurylphosphate (crystalline powder) | 5 | 10 | 5 | 15 | 5 |
| Sodium laurate (crystalline powder) | 5 | — | 5 | 10 | 5 |
| Lauroyl amidopropylbetaine | 1*1 | 1*1 | 1*1 | 2*1 | 1*1 |
| Polyoxyethylene (12) lauryl ether | 5 | — | — | 5 | 5 |
| Polyoxyethylene (9) sec-tetradecyl-ether*2 | — | 5 | — | — | — |
| Water | 2*1 | 2*1 | 2*1 | 6*1 | 62*1 |
| Hydroxypropyl cellulose | 2 | 2 | 2 | 2 | 2 |
| Viscosity (cp) at 25° C. | 14000 | 12000 | 18000 | 24000 | 12000 |
| State of neutral salt type anionic surfactant | A | A | A | A | B |
| Evaluation | | | | | |
| Feeling of refreshment just after cleansing | A | A | A | A | B |
| Feeling of refreshment 3 hrs after cleansing | A | A | A | A | C |
| Stretched feeling | B | B | B | B | C |
| Dry, flaky feeling (desquamation) | — | — | — | — | + |

*water content contains that attributable to a 33 wt. % aqueous solution of lauroyl amidopropylbetaine. The amount of lauroyl amidopropylbetaine is the net amount.
*2"Softanol 90", trade name; product of Nippon Shokubai Kagaku Co., Ltd.

Example 4

A detergent was prepared in a manner known Per se in the art from the components shown in Table 4. The state of the anionic surfactant in the system, massaging properties upon cleansing and change in roughness of the pores were evaluated. The results are shown in Table 4.

(Evaluation method)

State of the neutral type anionic surfactant

The state was confirmed in a similar manner to Example 1.

The massaging Properties upon cleansing and chance in the roughness of the pores Experts forming a panel used one of the detergents for half of their face and the other detergent for the other half by massaging without water, then foaming them with water and thereby cleansing their face. The massaging properties in the above case were evaluated in accordance with the following standards. In addition, changes in the roughness of the pores were evaluated after cleansing was conducted once a day for 2 weeks.

Evaluation standards (massaging properties):

A: Good

B: Slightly good

C: Not so good

TABLE 4

| | Invention product 12 | Comparative product 6 |
|---|---|---|
| Hexylene glycol | 40 | — |
| Isoprene glycol | 40 | — |
| Propylene glycol | 10 | 10 |
| Potassium laurylphosphate (crystalline powder) | 3 | 3 |
| Potassium lauryl glyceryl ether sulfonate (crystalline powder) | 3<br>2 | 3 |
| Lauroyl diethanolamide | 2 | 2 |
| Water | — | 80 |
| Hydroxypropyl cellulose | 2 | 2 |
| Viscosity (cp) at 25° C. | 18000 | 12000 |
| State of neutral salt type anionic surfactant | A | B |
| Evaluation | | |
| Massaging properties | A | C |
| Change in roughness of pores | Decrease | No change |

This application is based on Japanese patent application No. 9-092341, which is incorporated herein by reference in its entirety.

What is claimed is:

1. A detergent composition, which comprises the following components (A), (B) and (C):

(A) 50 to 95 wt. % of a polyol or polyol ether which can dissolve at least 1 wt. % of palmitic acid at 35° C., (B) 1 to 30 wt. % of crystals of a neutral salt of an anionic surfactant whose maximum particle size, defined as the largest dimension when viewed from three optical angles is 2 mm, and wherein component (B) does not dissolve in component (A), and (C) 0.1 to 20 wt. % of a thickener; and has a water content of 10 wt. % or less.

2. A detergent composition according to claim 1, wherein component (A) is selected from the group consisting of diethylene glycol monoethyl ether, isoprene glycol, 1,2-pentane diol, polyoxyethylene glycol (average molecular weight is about 400), hexylene glycol, dipropylene glycol, ethylene glycol monobutyl ether, ethylene glycol monoethyl ether, 1,3-butylene glycol, 2-ethyl-1,3-hexanediol, diethylene glycol, propylene glycol and tris(ethoxyethoxyethyl) phosphate.

3. A detergent composition according to claim 1, wherein the viscosity at 25° C. is 5,000 to 70,000 cp.

4. A detergent composition according to claim 1, which is a facial cleansing composition.

5. A detergent composition according to claim 1, wherein the amount of component (A) is from 60 to 90 wt. %.

6. A detergent composition according to claim 1, wherein component (B) has a particle size such that it permits easy dissolution by water at the time of rinsing when using said composition as a detergent.

7. A detergent composition according to claim 6, wherein the particle size of component (B) is 500 $\mu$m or less.

* * * * *